US006178863B1

(12) United States Patent
Kobayashi et al.

(10) Patent No.: US 6,178,863 B1
(45) Date of Patent: Jan. 30, 2001

(54) PAPER TRANSFER ASSEMBLY, AND IMAGE READING AND/OR RECORDING APPARATUS INCORPORATING THE SAME

(75) Inventors: Akira Kobayashi, Anjo; Shigeyuki Hayashi, Motosu-gun, both of (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 08/897,638

(22) Filed: Jul. 21, 1997

(30) Foreign Application Priority Data

Jul. 22, 1996 (JP) ..... 8-191932

(51) Int. Cl.[7] ..... B26D 7/06
(52) U.S. Cl. ..... 83/649; 358/419
(58) Field of Search ..... 83/649, 156, 650, 83/161; 358/414, 495, 304

(56) References Cited

U.S. PATENT DOCUMENTS 1,326,986 * 1/1920 Straubel ..... 358/414
3,645,157 * 2/1972 Di Giulio et al. ..... 83/650
4,557,169 * 12/1985 Kajiya et al. ..... 83/161
4,848,201 * 7/1989 Urwyler et al. ..... 83/649
5,134,915 * 8/1992 Fukano et al. ..... 83/649
5,226,639 7/1993 Kida et al. .
5,375,494 * 12/1994 Kajita et al. ..... 83/649
5,691,826 * 11/1997 Yeh et al. ..... 358/414
5,764,372 * 6/1998 Kondo ..... 358/414
5,857,393 * 1/1999 Kohiyama ..... 83/649

FOREIGN PATENT DOCUMENTS 2-2677717 7/1997 (JP) .

* cited by examiner

*Primary Examiner*—M. Rachuba
*Assistant Examiner*—Omar Flores-Sánchez
(74) *Attorney, Agent, or Firm*—Oliff & Berridge, PLC

(57) ABSTRACT

A paper transfer assembly is provided which includes a p reversibly rotatable drive motor, a paper transfer roller for transferring a paper, a first transmission mechanism connected to the paper transfer roller, and a second transmission mechanism separate from the first transmission mechanism. The second transmission mechanism may be used to drive a cutter device for automatically cutting the paper. Alternatively, the second transmission mechanism may be utilized for reversely moving the paper by providing a reversal mechanism for connecting the first transmission mechanism and the second transmission mechanism.

15 Claims, 6 Drawing Sheets

PAPER TRANSFER ASSEMBLY, AND IMAGE READING AND/OR RECORDING APPARATUS INCORPORATING THE SAME

BACKGROUND OF THE INVENTION

1. Field of the Invention

The present invention relates to a paper transfer assembly which may be incorporated in an image reading and/or recording apparatus (e.g. facsimile machine, printer) for feeding a substantially continuous paper from a roll thereof. The present invention also relates to an image reading and/or recording apparatus incorporating such a paper transfer assembly.

2. Description of the Related Art

A facsimile machine is well know which is designed to print images onto a substantially continuous paper paid out from a roll thereof. One type of facsimile machine may be designed to automatically cut the paper after printing. Another type of facsimile machine may be designed so that the user manually cuts the paper after printing.

As shown in FIG. 10 of the accompanying drawings, a facsimile machine F' of the manual cutting type comprises a recording platen roller 3' for feeding a continuous paper K' from a roll thereof while pressing the paper K' against a printhead 3A'. After printing at the printhead 3A', the user manually cuts the paper K' by utilizing a cutting edge 11' of the machine housing at a paper outlet 10'.

As clearly appreciated from FIG. 10, since the manual cutting edge 11' need be located at the paper outlet 10', the distance L between the platen roller 3'(or the printhead 3A') and the manual cutting edge 11' becomes inevitably large. This distance L corresponds to a blank portion of a cut paper piece K'1, so that a non-negligible amount of the paper K' is wasted. Thus, it is desired to provide a paper transfer assembly which has the function of reversely moving the paper K' after forwardly feeding and manually cutting it but before starting the next printing operation.

On the other hand, a facsimile machine of the automatic paper cutting type incorporates a cutter device located relatively close to the platen roller (or the printhead). Thus, the paper transfer assembly need not have an additional function of reversely moving the paper. Instead, the paper transfer assembly need have an additional function of driving the cutter device.

In this way, the two types of facsimile machine differ greatly from each other with respect to the requirements of the paper transfer assembly. Thus, it has been conventionally necessary to prepare two different kinds of paper transfer assembly for incorporation into the two different types of facsimile machine, consequently resulting in an increase of the production cost. Further, the facsimile machine of the automatic paper cutting type may requires two different motors for driving the platen roller and the cutter device, respectively, which also causes a cost increase.

SUMMARY OF THE INVENTION

Therefore, an object of the present invention is to provide a paper transfer assembly which can be alternatively utilized for driving a cutter device or for reversibly feeding a paper by addition or omission of a simple element, thereby reducing the production cost of an apparatus which incorporates the paper cutting transfer assembly even if an automatic paper function is added or omitted.

Another object of the present invention is to provide an image recording apparatus which incorporates such a paper transfer assembly.

A further object of the present invention is to provide a paper transfer assembly which is capable of selectively driving three different transmission mechanisms only by a single drive motor.

Still another object of the present invention is provide an image reading and recording apparatus which incorporates such a paper transfer assembly.

According to a first aspect of the present invention, there is provided a paper transfer assembly comprising: a drive motor which is reversibly rotatable; a paper transfer roller for transferring a paper; a first transmission mechanism connected to the paper transfer roller; a second transmission mechanism separate from the first transmission mechanism; a reversal mechanism for connecting the first transmission mechanism and the second transmission mechanism; and a changeover mechanism for releasably connecting the drive motor to the first transmission mechanism to rotate the paper transfer roller in a forward direction when the motor is rotated in a first direction, and for releasably connecting the drive motor to the second transmission mechanism to rotate the paper transfer roller in a reverse direction via the reversal mechanism and the first transmission mechanism when the motor is rotated in a second direction opposite to said first direction.

With the paper transfer assembly described above, the first transmission mechanism is used for forwardly rotating the paper transfer roller, whereas the second transmission mechanism is combined with the reversal mechanism for reversely rotating the paper transfer roller. Thus, when the apparatus such as a thermal printer incorporating the paper transfer assembly is not provided with an automatic cutter device, the paper may be reversely moved by a desired amount after manual cutting, thereby avoiding a waste of the paper which may result from manual cutting.

On the other hand, if an automatic cutting function is desired, the reversal mechanism may be omitted, and a cutter device may, instead, be connected to the second transmission mechanism for cutting the paper. In this case, no modification need be made with respect to the first and second transmission mechanisms per se. Thus, the same paper transfer assembly can be utilized for two types of apparatus (one having an automatic paper cutting function, and the other having a paper reversing function), thereby reducing the production cost of the apparatus.

According to a preferred embodiment of the present invention, each of the first and second transmission mechanisms comprises a plurality of gears, and the reversal mechanism comprises at least one reversal gear in mesh with a selected gear of the first transmission mechanism and a selected gear of the second transmission mechanism. Further, the changeover mechanism comprises a planetary gear mechanism which includes a sun gear operatively connected to the drive motor, a first planetary gear held in mesh with the sun gear for revolution therearound while making self-rotation, and a second planetary gear held in mesh with the sun gear for revolution therearound while making self-rotation. In this case, the first planetary gear comes into mesh with a predetermined gear of the first transmission mechanism when the motor is rotated in said first direction, whereas the second planetary gear comes into mesh with a predetermined gear of the second transmission mechanism when the motor is rotated in said second direction.

Preferably, the paper transfer assembly may further comprise a second paper transfer roller for transferring a different paper, and a third transmission mechanism connected to the second paper transfer roller. With such an arrangement, the changeover mechanism can select a first operation mode in which the drive motor is connected only to the third transmission mechanism, a second operation mode in which the drive motor is connected only to the first transmission mechanism, a third operation mode in which the drive motor is connected to both of the first and third transmission mechanisms, and a fourth operation mode in which the drive motor is connected only to the second transmission mechanism.

According to a preferred embodiment, the changeover mechanism comprises a planetary gear mechanism and a control mechanism. Further, the planetary gear mechanism includes a sun gear operatively connected to the drive motor, a first planetary gear held in mesh with the sun gear for revolution therearound while making self-rotation, and a second planetary gear held in mesh with the sun gear for revolution therearound while making self-rotation.

According to the preferred embodiment described above, the control mechanism brings the first planetary gear into connection with the third transmission mechanism in the first operation mode while holding the second planetary gear in a neutral position. In the second operation mode, the control mechanism brings the first planetary gear into connection with the first transmission mechanism while holding the second planetary gear in the neutral position. In the third operation mode, the control mechanism brings the first and second planetary gears into connection with the first and third transmission mechanisms, respectively. In the fourth operation mode, the control mechanism brings the second planetary gear into connection with the second transmission mechanism in the fourth operation mode while holding the first planetary gear in a neutral position.

Preferably, the control mechanism comprises a first lever arm for holding the first planetary gear in its neutral position, a second lever arm for holding the second planetary gear in its neutral position, and an actuation device for moving the first and second lever arms. The actuation device may be advantageously a solenoid.

According to a second aspect of the present invention, there is provided a paper transfer assembly comprising: a drive motor which is reversibly rotatable; a first paper transfer roller for transferring a first paper; a first transmission mechanism connected to the first paper transfer roller; a second transmission mechanism separate from the first transmission mechanism; a second paper transfer roller for transferring a second paper; a third transmission mechanism connected to the second paper transfer roller and provided separately from the first and second transmission mechanisms; and a changeover mechanism for selectively connecting the drive motor to the first to third transmission mechanisms. More specifically, the changeover mechanism selects a first operation mode in which the drive motor is connected only to the third transmission mechanism, a second operation mode in which the drive motor is connected only to the first transmission mechanism, a third operation mode in which the drive motor is connected to both of the first and third transmission mechanisms, and a fourth operation mode in which the drive motor is connected only to the second transmission mechanism.

The paper transfer assembly may further comprise a cutter device operatively connected to the second transmission mechanism for cutting the first paper in the fourth operation mode. Alternatively, the paper transfer assembly may further comprise a reversal mechanism connecting the first transmission mechanism and the second transmission mechanism for reversely moving the first paper in the fourth operation mode.

According to a third aspect of the present invention, there is provided an image recording apparatus comprising: a drive motor which is reversibly rotatable; a paper transfer roller for transferring a recording paper; a printhead for printing images onto the recording paper; a first transmission mechanism connected to the paper transfer roller; a second transmission mechanism separate from the first transmission mechanism; a reversal mechanism for connecting the first transmission mechanism and the second transmission mechanism; and a changeover mechanism for releasably connecting the drive motor to the first transmission mechanism to rotate the paper transfer roller in a forward direction when the motor is rotated in a first direction, and for releasably connecting the drive motor to the second transmission mechanism to rotate the paper transfer roller in a reverse direction via the reversal mechanism and the first transmission mechanism when the motor is rotated in a second direction opposite to said first direction.

According to a fourth aspect of the present invention, there is provided an image reading and recording apparatus comprising: a drive motor which is reversibly rotatable; a first paper transfer roller for transferring a recording paper; a printhead for printing images onto the recording paper; a first transmission mechanism connected to the first paper transfer roller; a second transmission mechanism separate from the first transmission mechanism; a second paper transfer roller for transferring a document paper; an image reading unit for reading images from the document paper; a third transmission mechanism connected to the second paper transfer roller and provided separately from the first and second transmission mechanisms; and a changeover mechanism for selectively connecting the drive motor to the first to third transmission mechanisms.

Other objects, features and advantages of the present invention will be apparent from the detailed description of the embodiment given below with reference to the accompanying drawings.

DETAILED DESCRIPTION OF THE PREFERRED EMBODIMENTS

The preferred embodiments of the present invention will be described below with reference to the accompanying drawings.

Figure 1:
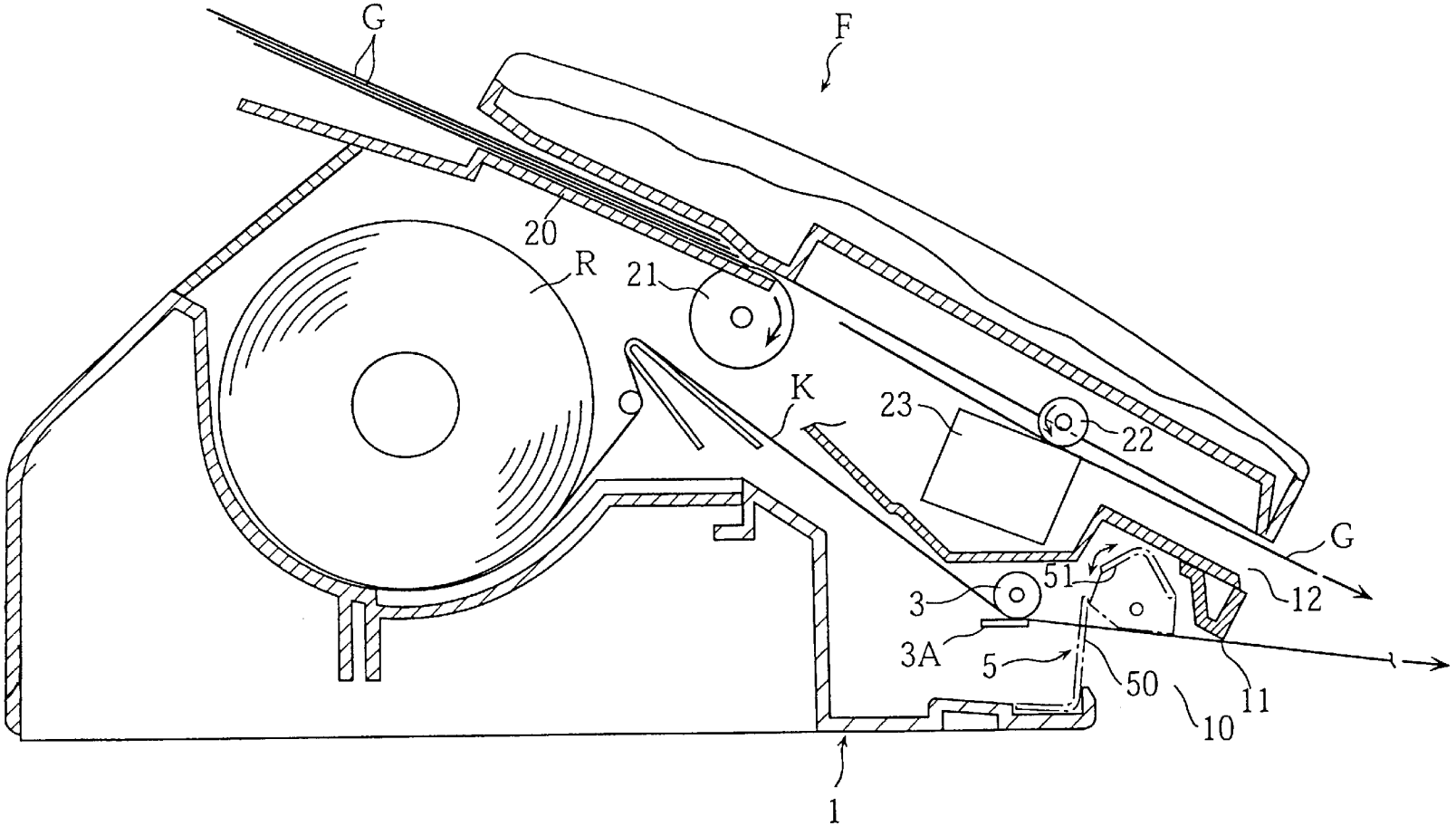
FIG. 1 is a side view, partly in section, schematically showing a facsimile machine which incorporates a paper transfer assembly embodying the present invention.

FIG. 1 of the accompanying drawings schematically illustrates the overall arrangement of a facsimile machine which incorporates a paper transfer assembly embodying the present invention. The facsimile machine, generally designated by reference sign F, includes a machine housing 1 which may be made of a synthetic resin for example. The housing 1 accommodates a roll R of a continuous recording paper K which may be typically a thermosensitive paper.

The recording paper K paid out from the roll R is advanced by a printing platen roller 3 for discharge through a first paper outlet 10. The platen roller 3 is arranged in facing relationship to a printhead 3A which may be typically a thermal head. The combination of the printing platen roller 3 and the printhead 3A is followed by a cutter device 5 arranged at the first paper outlet 10.

According to the illustrated embodiment, the cutter device 5 includes a stationary blade 50 arranged under the moving path of the recording paper K, and a movable blade 51 disposed above the paper moving path for pivoting about a pivot shaft 51*a*. The stationary blade 50 has an upwardly directed cutting edge which extends widthwise of the recording paper K. The movable blade 51 has a downwardly directed cutting edge which comes into and out of shearing contact with the cutting edge of the stationary blade 50 when the movable blade 51 is pivoted up and down.

On the other hand, it is also possible to dispense with the cutter device 5. In such a case, the user may manually pull up the recording paper K against a manual cutting edge 11 provided at the outer extremity of the first paper outlet 10 above the paper moving path, thereby tearing the paper K.

The facsimile machine further includes a document receiver 20 for supporting a suitable stack of document papers G (original papers to be read), a feed roller 21 for feeding the document papers G one after another, a reading platen roller 22 for transferring the thus fed document paper G toward a second paper outlet 12, and an image reading unit 23 disposed in facing relationship to the reading platen roller 22. The reading platen roller 22 may be a white roller. Though not illustrated, the image reading unit 23 incorporates a light source for irradiating the document paper G with light, an optical system for guiding the light reflected from the document paper G, and an image sensor such as a CCD (charge coupled device) sensor for generating image signals on the basis of the reflected light.

Figure 2:
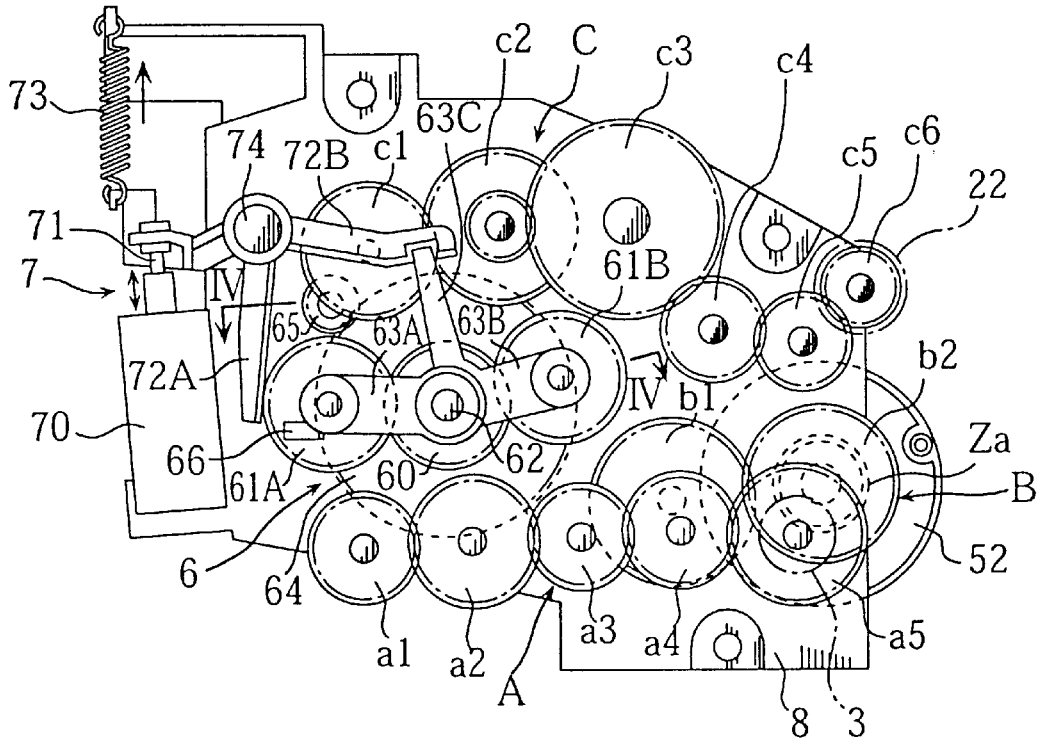
FIG. 2 is a schematic side view showing the arrangement of the paper transfer assembly.

As shown in FIG. 2, the paper transfer assembly incorporated in the facsimile machine F includes a planetary gear mechanism 6, a drive motor M (FIG. 4) for driving the planetary gear mechanism 6, a control mechanism 7 for controlling the planetary gear mechanism 6, a first transmission mechanism A releasably connectable to the planetary gear mechanism 6 for driving the printing platen roller 3, a second transmission mechanism B releasably connectable to the planetary gear mechanism 6 for driving the movable blade 51 of the cutter device 5 (see FIG. 1), and a third transmission mechanism C releasably connectable to the planetary gear mechanism 6 for driving the reading platen roller 22. The control mechanism 7 controls the planetary gear mechanism 6 for its selective connection to or disconnection from the first to third transmission mechanisms A, B, C, respectively, as described hereinafter. Thus, the single motor M can be utilized for selectively driving the printing platen roller 3, the reading platen roller 22 and the movable blade 51.

The first transmission mechanism A comprises a train of gears a1–a5 in successive mesh. The last gear a5 of the gear train is connected to one end of the printing platen roller 3. Thus, when the last gear a5 rotates, the printing platen roller 3 also rotates in the same rotational direction.

As previously described, the second transmission mechanism B is provided basically for driving the movable blade 51 of the cutter device 5. However, in case where no such cutter device is provided, the second transmission mechanism B may be utilized for reversely rotating the printing platen roller 3, as described hereinafter.

The second transmission mechanism B comprises two gears b1, b2 in mesh with each other, and a coaxial gear Za concentric with the gear b2 for integral rotation therewith. The gear b2 is connected to a distal flange 52 for integral rotation therewith.

As illustrated in FIGS. 3*a* through 3*d*, the distal flange 52 carries an engaging pin 52*a*, whereas the movable blade 51 of the cutter device 5 has an integral extension 51*b* formed with a guide slot 51*c* for slidably receiving the engaging pin 52*a* of the distal flange 52. Thus, when the distal flange 52 rotates counterclockwise, the movable blade 51 pivots up and down about the pivot shaft 51*a* for cutting the recording paper K and thereafter returning to its home position.

Figure 9:
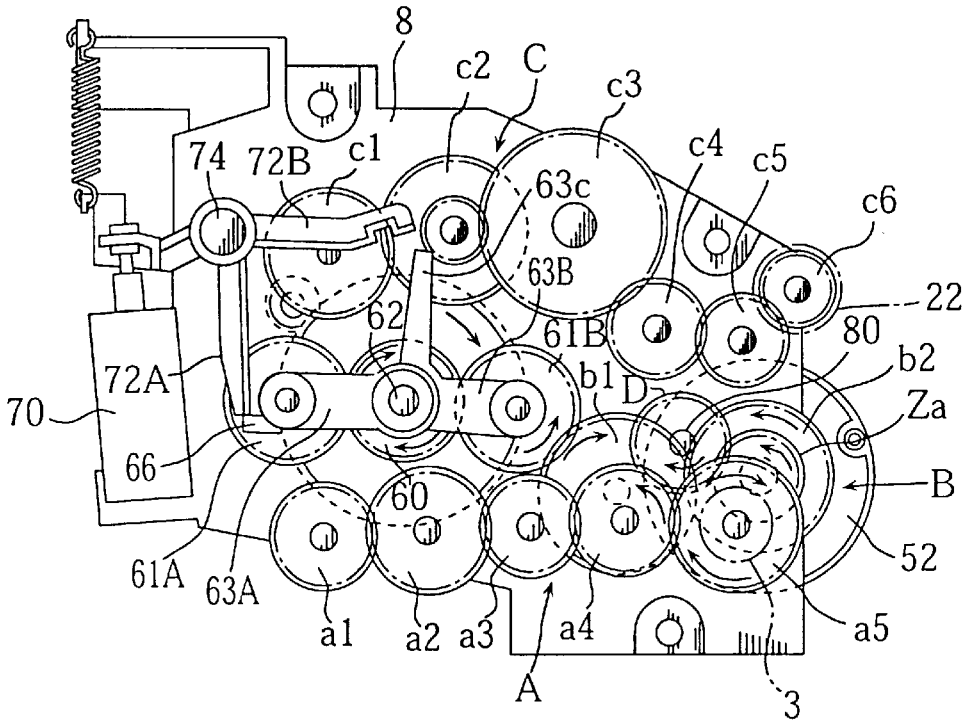
FIG. 9 is a side view similar to FIG. 2 but showing the same paper transfer assembly as modified for manual paper cutting and for reversing the movement of the recording paper.
Figure 10:
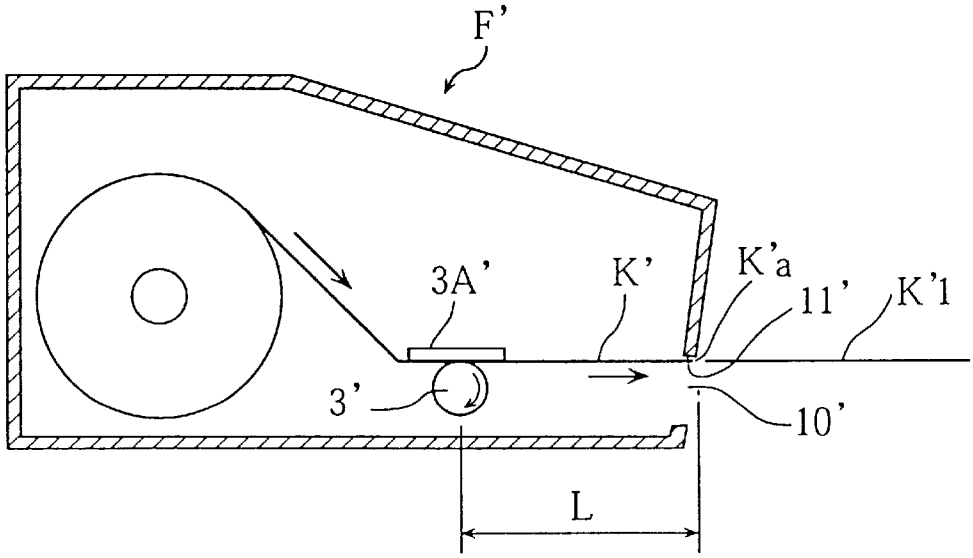
FIG. 10 PRIOR ART
FIG. 10 is a side view, partly in section, schematically showing a prior art facsimile machine.

In place of providing the cutter device 5 (i.e., in case where no automatic cutter device is provided), a reversal gear D may be added which transmits rotation of the gear b2 of the second transmission mechanism B to the gear a4 of the first transmission mechanism A, as shown in FIG. 9. More specifically, the reversal gear D is held in mesh with the coaxial gear Za of the second transmission mechanism B and the gear a4 of the first transmission mechanism A. The reversal gear D may be mounted on a frame (not shown) which also carries the train of gears a1–a5 of the first transmission mechanism A.

The third transmission mechanism C comprises a train of gears c1–c6 in successive mesh. The last gear c6 of the gear train is connected to one end of the reading or white platen roller 22. Thus, when the last gear c6 rotates, the white platen roller 22 also rotates in the same rotational direction.

The planetary gear mechanism 6 is combined with the control mechanism 7 to provide a drive transmission path changeover mechanism. The planetary gear mechanism 6 includes a sun gear 60 rotatably supported on a central shaft 62, and two planetary gears 61A, 61B held in mesh with the sun gear 60 for revolution therearound while making self-rotation. The planetary gear 61A (hereafter referred to as "first planetary gear") is carried by a first arm 63A which is pivotally supported on the central shaft 62, whereas the other planetary gear 61B (hereafter referred to as "second planetary gear") is retained by a second arm 63B which is also supported on the central shaft 62 to pivot independently of the first arm 63A. The first arm 63A has a free end provided with a stopper piece 66. Further, the second arm 63B is integrally formed with an extension arm 63C.

Figure 4:
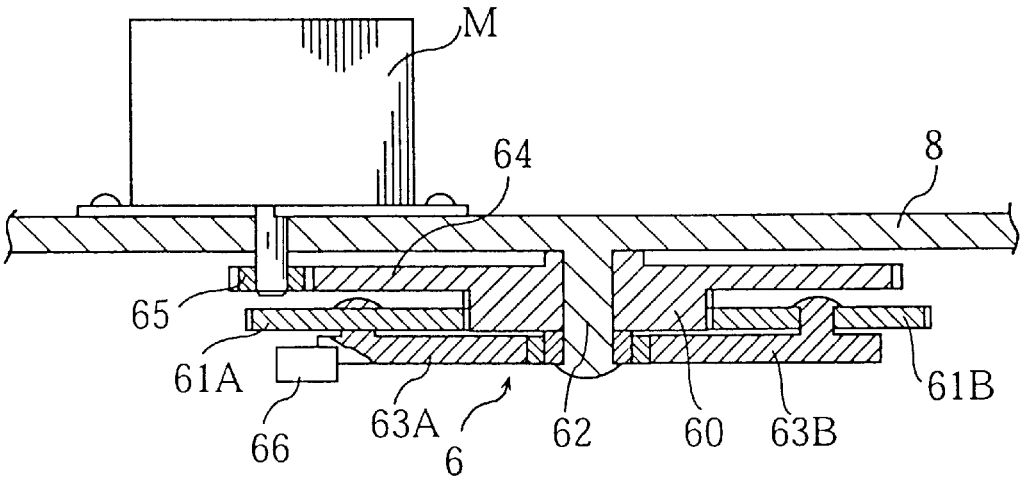
FIG. 4 is an enlarged sectional view taken along lines IV—IV in FIG. 2.
Figure 3A:
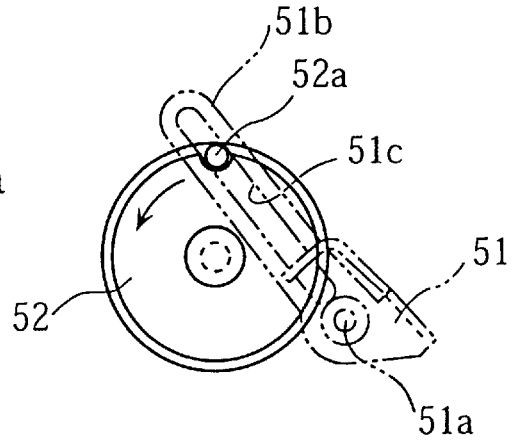
FIGS. 3A–3D are slightly enlarged side view showing the relationship between a cutter device and a discal flange in the same facsimile machine.
Figure 3B:
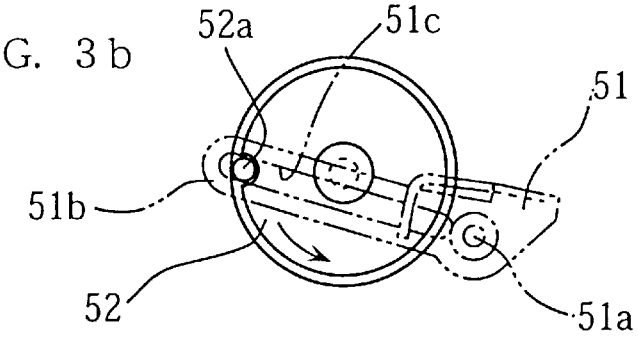
Figure 3C:
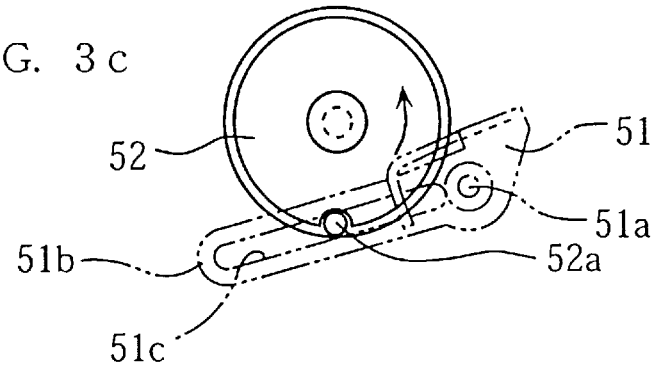
Figure 3D:
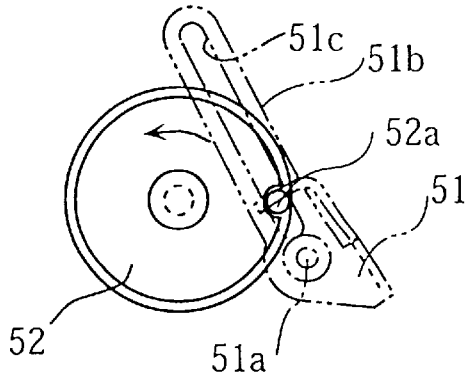

As best shown in FIG. 4, the sun gear 60 is integrally formed with a diametrically larger follower gear 64 held in mesh with a drive gear 65 which is fixed on the drive shaft of the motor M. Thus, when the motor M is actuated, the sun gear 60 causes revolution and self-rotation of the planetary gears 61A, 61B to perform an intended transmission path changeover while also performing an intended drive transmission, as described later. The motor M is rotatable forwardly and reversely through a desired angle.

The control mechanism 7 includes a solenoid 70, a reciprocating rod 71 activated by the solenoid 70, and a spring 73 for always biasing the reciprocating rod 71 in an advancing direction (upward in FIG. 2). The control mechanism also includes a first lever arm 72A supported for pivotal movement about a pivot shaft 74, and a second lever arm 72B also supported for pivotal movement about the pivot shaft 74 integrally with the first lever arm 72A.

When the reciprocating rod 71 is reciprocated by the solenoid 70, the two lever arms 72A, 72B pivot together about the pivot shaft 74 for restraining the movement of the two arms 63A, 63B of the planetary gear mechanism 6 in different ways. More specifically, when the solenoid 70 is turned off to allow advance or extension of the reciprocating rod 71, the first lever arm 72A is held out of engagement with the first arm 63A of the planetary gear mechanism 6 (see FIG. 2), so that the first planetary gear 61A can revolve around the sun gear 60 to come into selective mesh with the initial gear c1 of the third transmission mechanism C (see FIG. 5) or the initial gear a1 of the first transmission mechanism A (see FIG. 6) depending on the rotational direction of the sun gear 60. Further, with the solenoid 70 turned off, the second lever arm 72B is held in engagement with the extension arm 63C to restrain pivotal movement of the second arm 63B, thereby preventing the second planetary gear 61B from revolving around the sun gear 60 (see FIGS. 2, 5 and 6).

Figure 7:
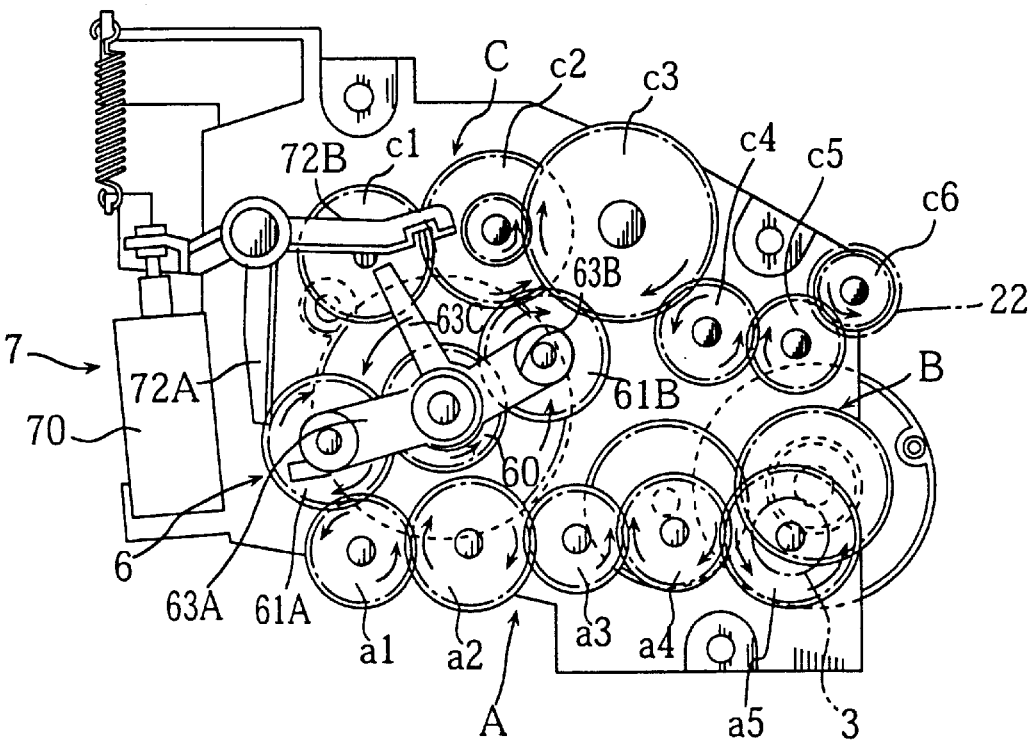
FIG. 7 is a side view similar to FIG. 2 but showing the same paper transfer assembly in a third operation mode for simultaneously feeding the document paper and the recording paper.
Figure 8:
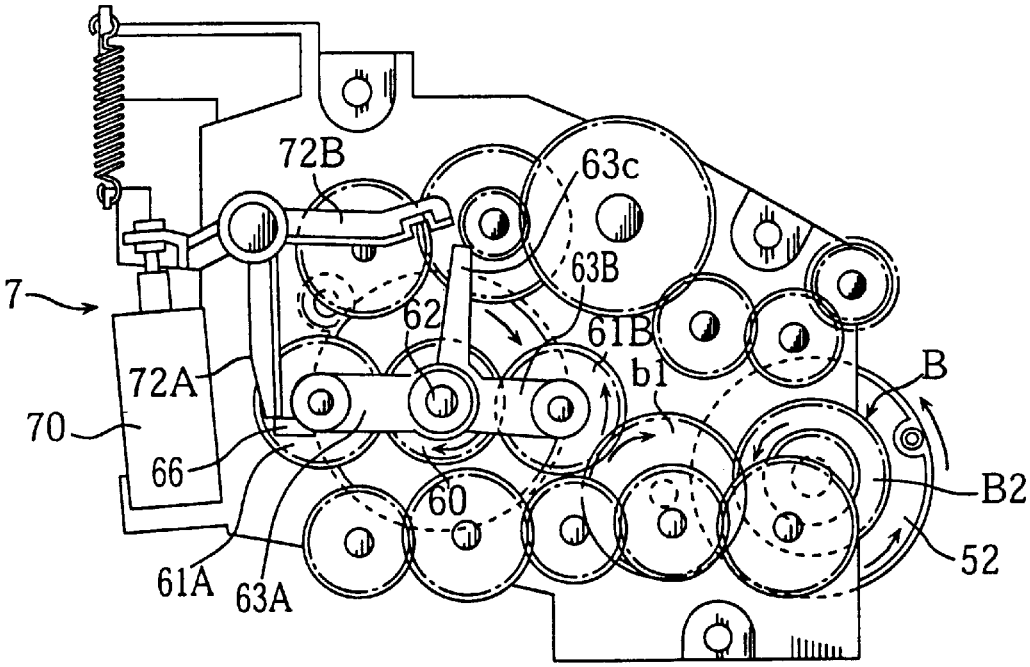
FIG. 8 is a side view similar to FIG. 2 but showing the same paper transfer assembly in a fourth operation mode for cutting the recording paper.

On the other hand, when the solenoid 70 is turned on to retract the reciprocating rod 71, the first lever arm 72A comes into engagement with the stopper piece 66, thereby preventing the first arm 63A of the planetary gear mechanism 6 from pivoting upward, as shown in FIGS. 7 and 8. Further, with the solenoid 70 turned on, the second lever arm 72B is brought out of engagement with the extension arm 63C to allow pivotal movement of the second arm 63B, thereby enabling the second planetary gear 61B to revolve around the sun gear 60 for coming into selective engagement with the gear c2 of the third transmission mechanism C (see FIG. 7) or the gear b1 of the second transmission mechanism B (see FIG. 8) depending on the rotational direction of the sun gear 60.

The facsimile machine F incorporating the above-described paper transfer assembly can be operated in four different operation modes by turning on and off the solenoid 70 of the control mechanism 7 in addition to forwardly and reversely rotating the drive motor M. In reality, however, when the reversal gear D (FIG. 9) is added in place of providing the cutter device 5, an additional operation mode will result.

Figure 5:
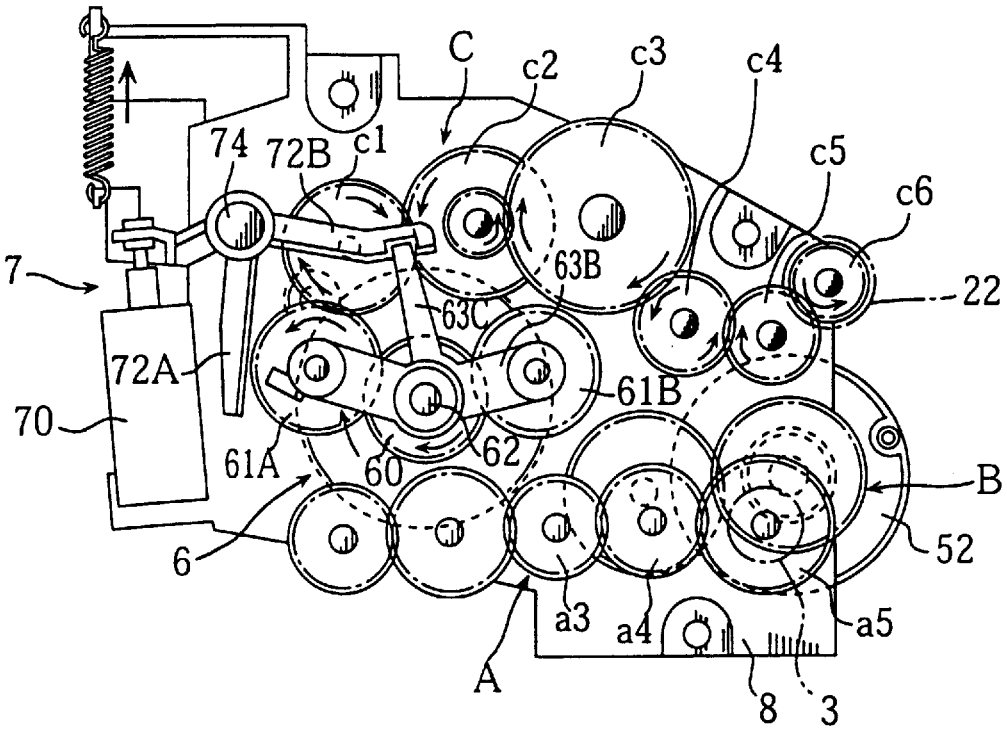
FIG. 5 is a side view similar to FIG. 2 but showing the same paper transfer assembly in a first operation mode for feeding a document paper.

In a first operation mode, the drive motor M is rotated in a forward direction to rotate the sun gear 60 of the planetary gear mechanism 6 clockwise (as viewed in FIG. 2) with the solenoid 70 of the control mechanism 7 turned off, as shown in FIG. 5. The forward (clockwise) rotation of the sun gear 60 causes the first planetary gear 61A to make counterclockwise self-rotation while revolving around the sun gear 60 clockwise until the first planetary gear 61A comes into mesh with the initial gear c1 of the third transmission mechanism C. As a result, the motor drive is transmitted through the gear train c1–c6 of the third transmission mechanism C to rotate the reading platen roller 22 for feeding the document paper G toward the second paper outlet 12 while the paper G is read at the image reading unit 23.

In the first operation mode, the second lever arm 72B of the control mechanism 7 is held in engagement with the extension arm 63C to restrain pivotal movement of the second arm 63B, thereby preventing the second planetary gear 61B from revolving around the sun gear 60. As a result, the second planetary gear 61B is retained in a neutral or idle position not meshing with any gear of the first to third transmission mechanisms A-C. Thus, the first operation mode is suitable for reading the images of the document paper G to make facsimile transmission.

Figure 6:
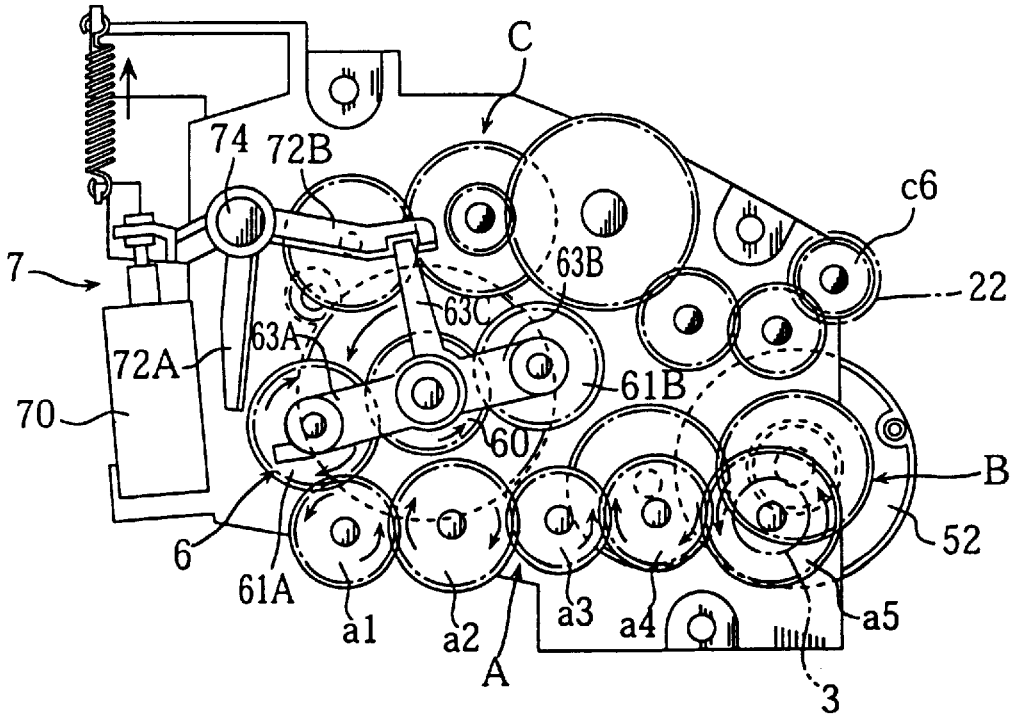
FIG. 6 is a side view similar to FIG. 2 but showing the same paper transfer assembly in a second operation mode for feeding a recording paper.

In a second operation mode, the drive motor M is rotated in a reverse direction to rotate the sun gear 60 of the planetary gear mechanism 6 counterclockwise with the solenoid 70 of the control mechanism 7 again turned off, as shown in FIG. 6. The reverse (counterclockwise) rotation of the sun gear 60 causes the first planetary gear 61A to make clockwise self-rotation while revolving around the sun gear 60 counterclockwise until the first planetary gear 61A comes into mesh with the initial gear a1 of the first transmission mechanism A. As a result, the motor drive is transmitted through the gear train a1–a5 of the first transmission mechanism A to rotate the recording platen roller 3 for feeding the recording paper K toward the first paper outlet 10 while intended printing is performed onto the paper K by the printhead 3A.

In the second operation mode, again, the second lever arm 72B of the control mechanism 7 is held in engagement with the extension arm 63C to restrain pivotal movement of the second arm 63B, thereby retaining the second planetary gear 61B in the neutral position not meshing with any gear of the first to third transmission mechanisms A-C. Thus, the second operation mode is suitable for printing out the image data received from a remote facsimile machine for example.

In a third operation mode, the drive motor M is rotated reversely to rotate the sun gear 60 of the planetary gear mechanism 6 counterclockwise with the solenoid 70 of the control mechanism 7 turned on. Due to the actuation of the solenoid 70, the second lever arm 72B of the control mechanism 7 disengages from the extension arm 63C to allow pivotal movement of the second arm 63B, as shown in FIG. 7. Thus, the reverse (counterclockwise) rotation of the sun gear 60 causes both of the first and second planetary gears 61A, 61B to make clockwise self-rotation while revolving around the sun gear 60 counterclockwise. As a result, the first planetary gear 61A comes into mesh with the initial gear a1 of the first transmission mechanism A to transmit a portion of the motor drive through the gear train a1–a5 for feeding the recording paper K toward the first paper outlet 10, whereas the second planetary gear 61B comes into mesh with the gear c2 of the third transmission mechanism C to transmit the remaining portion of the motor drive through the gear train c2–c6 for feeding the document paper G toward the second paper outlet 12.

In the third operation mode, the recording paper K and the document paper G are transferred simultaneously. Thus, the third operation mode is suitable for the copy mode of the facsimile machine F for example.

In a fourth operation mode, the drive motor M is rotated forwardly to rotate the sun gear 60 of the planetary gear mechanism 6 clockwise with the solenoid 70 of the control mechanism 7 turned on, as shown in FIG. 8. The forward (clockwise) rotation of the sun gear 60 causes both of the first and second planetary gears 61A, 61B to make counterclockwise self-rotation while revolving around the sun gear 60 clockwise. However, the stopper piece 66 of the first arm 63 comes into abutment with the first lever arm 72A of the control mechanism 7 before the first planetary gear 61A comes into engagement with the initial gear c1 of the third transmission mechanism. Thus, the first planetary gear 61A is held in a neutral or idle position not meshing with any gear of the first to third transmission mechanisms A-C.

By contrast, the second planetary gear 61B continues to revolve around the sun gear 60 clockwise until it comes into mesh with the gear b1 of the second transmission mechanism B. As a result, the motor drive is transmitted through the gears b1, b2 of the second transmission mechanism B for rotating the distal flange 52. Thus, if the facsimile machine F is provided with the cutter device 5, the rotation of the distal flange 52 causes the movable blade 51 to pivot up and down for automatically cutting the recording paper K.

On the other hand, when the facsimile machine F is not provided with the cutter device 5, the reversal gear D is interposed between the coaxial gear Za (coaxial with the gear b2 of the second transmission mechanism B) and the gear a4 of the first transmission mechanism A, as shown in FIG. 9. As a result, the motor drive can be utilized for reversing the movement of the recording paper K.

More specifically, in a fifth operation mode which is an alternative to the fourth operation mode described above, the drive motor M is rotated forwardly to rotate the sun gear 60 of the planetary gear mechanism 6 clockwise with the solenoid 70 of the control mechanism 7 turned on (FIG. 9). Like the fourth operation mode described above, the forward (clockwise) rotation of the sun gear 60 causes both of the first and second planetary gears 61A, 61B to make counterclockwise self-rotation while revolving around the sun gear 60 clockwise. However, the stopper piece 66 of the first arm 63 comes into abutment with the first lever arm 72A of the control mechanism 7 before the first planetary gear 61A comes into engagement with the initial gear c1 of the third transmission mechanism. Thus, the first planetary gear 61A is held in the neutral or idle position not meshing with any gear of the first to third transmission mechanisms A-C.

By contrast, the second planetary gear 61B continues to revolve around the sun gear 60 clockwise until it comes into mesh with the gear b1 of the second transmission mechanism B. As a result, the motor drive is transmitted through the gears b1, b2 of the second transmission mechanism B, the coaxial gear Za, reversal gears and the gears a4, a5 of the first transmission mechanism A for reversely rotating the recording platen roller 3, thereby rearwardly moving the recording paper K.

As previously described in connection with FIG. 1, the recording paper K may be manually cut by utilizing the manual cutting edge 11 when the cutter device 5 is obviated. In this case, however, a portion of the recording paper K extending between the recording platen roller 3 and the manual cutting edge 11 is wasted if no countermeasure is taken. The fifth operation mode described above is effective for minimizing such a waste of the recording paper K by reverse movement thereof which may be performed immediately before starting the next printing operation In the fifth operation mode, the distal flange 52 is also rotated. However, since the cutter device 5 is obviated in this operation mode, such rotation of the distal flange 52 has no adverse influence on the reversal of the recording paper K. Of course, the distal flange 52 may be removed when the cutter device 5 is omitted.

As described above, the fifth operation mode takes the place of the fourth operation mode when the cutter device 5 is omitted. This means that the fourth operation mode (cutter drive mode) never occurs with respect to the type of facsimile machine F which incorporates no automatic cutter device. In this sense, the fifth operation mode may be considered as a fourth operation mode in such a type of facsimile machine.

According to the illustrated embodiment, the same paper transfer assembly may be alternatively utilized for one type of facsimile machine which has an automatic paper cutting function or another type of facsimile machine which has no automatic paper cutting function. In the former type of facsimile machine (incorporating the cutter device 5), the reverse rotation of the motor M is used for forwardly feeding the recording paper K, whereas the forward rotation of the motor M is used for driving the cutter device 5. In the latter type of facsimile machine (incorporating the reversal gear D), the reverse rotation of the motor M is used for forwardly feeding the recording paper K, whereas the forward rotation of the motor M is used to reversely move the recording paper K for avoiding wasteful use of the recording paper K. Thus, selection need only be made between the cutter device 5 and the reversal gear D, so that the production cost for both types of facsimile machine can be remarkably reduced by common use of the other parts.

Further, according to the illustrated embodiment, the combination of the planetary gear mechanism 6 and the control mechanism 7 allows the single motor M to drive the first to third transmission mechanisms A-C in four different ways. Thus, no additional motor need be provided for driving the three different transmission mechanisms A-C, so that the space of the facsimile machine F can be efficiently utilized.

In the illustrated embodiment, the reversal gear D is disposed between the gear a4 of the first transmission mechanism A and the coaxial gear Za of the second transmission mechanism B. However, the reversal gear D may be interposed between any selected gear of the first transmission mechanism A and any selected gear of the second transmission mechanism B. Further, a series of reversal gears may be used in place of the single reversal gear D in case where the spacing between the selected gears of the first and second transmission mechanisms A, B is relatively large. Moreover, the reversal gear D may be replaced by a timing belt.

Further, the third transmission mechanism C (i.e., the reading platen roller 22) may be driven by a separate motor. In this case, since the planetary gear mechanism 6 along can switch between the first transmission mechanism A and the second transmission mechanism B by reversibly rotating the motor M, the control mechanism 7 may also be dispensed with if the planetary gear mechanism 6 is made not to interfere with the third transmission mechanism C.

In the illustrated embodiment, the paper transfer assembly is incorporated in the facsimile machine F. However, the paper transfer assembly of the present invention may be incorporated in an image recording apparatus such as a thermal printer. In this case, the third transmission mechanism C together with its associated components (the document receiver 20, the feed roller 21, the reading platen roller 22, and the image reading unit 23) is omitted, as also is the control mechanism 7

The present invention being thus described, it is obvious that the same may be varied in many ways. Such variations should not be regarded as a departure from the spirit and scope of the present invention, and all such modifications as would be obvious to those skilled in the art are intended to be included within the scope of the following claims.

What is claimed is:

1. A paper transfer assembly, comprising:

a drive motor which is reversibly rotatable;

a paper transfer roller for transferring a paper;

a first transmission mechanism connected to the paper transfer roller;

a second transmission mechanism separate from the first transmission mechanism for driving at least the paper transfer roller;

a reversal mechanism for connecting the first transmission mechanism and the second transmission mechanism; and a changeover mechanism for releasably connecting the drive motor to the first transmission mechanism to rotate the paper transfer roller in a forward direction when the motor is rotated in a first direction, and for releasably connecting the drive motor to the second transmission mechanism to rotate the paper transfer roller in a reverse direction via the reversal mechanism and the first transmission mechanism when the motor is rotated in a second direction opposite to said first direction, wherein each of the first and second transmission mechanisms comprises a plurality of gears, the reversal mechanism comprising at least one reversal gear in mesh with a selected gear of the first transmission mechanism and a selected gear of the second transmission mechanism and the changeover mechanism comprises a planetary gear mechanism which includes a sun gear operatively connected to the drive motor, a first planetary gear held in mesh with the sun gear for revolution therearound while making self-rotation, and a second planetary gear held in mesh with the sun gear for revolution therearound while making self-rotation, the first planetary gear coming into mesh with a predetermined gear of the first transmission mechanism when the motor is rotated in said first direction, the second planetary gear coming into mesh with a predetermined gear of the second transmission mechanism when the motor is rotated in said second direction.

2. The paper transfer assembly according to claim 1, further comprising a cutter device connected to the second transmission mechanism for cutting the paper, the reversal mechanism being replaced by the cutter device.

3. A paper transfer assembly, comprising:

a drive motor which is reversibly rotatable;

a paper transfer roller for transferring a paper;

a first transmission mechanism connected to the paper transfer roller;

a second transmission mechanism separate from the first transmission mechanism for driving at least the paper transfer roller;

a reversal mechanism for connecting the first transmission mechanism and the second transmission mechanism;

a changeover mechanism for releasably connecting the drive motor to the first transmission mechanism to rotate the paper transfer roller in a forward direction when the motor is rotated in a first direction, and for releasably connecting the drive motor to the second transmission mechanism to rotate the paper transfer roller in a reverse direction via the reversal mechanism and the first transmission mechanism when the motor is rotated in a second direction opposite to said first direction, a second paper transfer roller for transferring a different paper; and a third transmission mechanism connected to the second paper transfer roller, wherein the changeover mechanism selecting a first operation mode in which the drive motor is connected only to the third transmission mechanism, a second operation mode in which the drive motor is connected only to the first transmission mechanism, a third operation mode in which the drive motor is connected to both of the first and third transmission mechanisms, and a fourth operation mode in which the drive motor is connected only to the second transmission mechanism.

4. The paper transfer assembly according to claim 3, wherein the changeover mechanism comprises a planetary gear mechanism and a control mechanism;

the planetary gear mechanism including a sun gear operatively connected to the drive motor, a first planetary gear held in mesh with the sun gear for revolution therearound while making self-rotation, and a second planetary gear held in mesh with the sun gear for revolution therearound while making self-rotation;

the control mechanism bringing the first planetary gear into connection with the third transmission mechanism in the first operation mode while holding the second planetary gear in a neutral position;

the control mechanism bringing the first planetary gear into connection with the first transmission mechanism in the second operation mode while holding the second planetary gear in the neutral position;

the control mechanism bringing the first and second planetary gears into connection with the first and third transmission mechanisms, respectively, in the third operation mode;

the control mechanism bringing the second planetary gear into connection with the second transmission mechanism in the fourth operation mode while holding the first planetary gear in a neutral position.

5. The paper transfer assembly according to claim 4, wherein the control mechanism comprises a first lever arm for holding the first planetary gear in its neutral position, a second lever arm for holding the second planetary gear in its neutral position, and an actuation device for moving the first and second lever arms.

6. The paper transfer assembly according to claim 5, wherein the actuation device of the control mechanism is a solenoid.

7. A paper transfer assembly, comprising:

a drive motor which is reversibly rotatable;

a first paper transfer roller for transferring a first paper;

a first transmission mechanism connected to the first paper transfer roller;

a second transmission mechanism separate from the first transmission mechanism;

a second paper transfer roller for transferring a second paper;

a third transmission mechanism connected to the second paper transfer roller and provided separately from the first and second transmission mechanisms; and a changeover mechanism for selectively connecting the drive motor to the first to third transmission mechanisms, wherein the changeover mechanism selects a first operation mode in which the drive motor is connected only to the third transmission mechanism, a second operation mode in which the drive motor is connected only to the first transmission mechanism, a third operation mode in which the drive motor is connected to both of the first and third transmission mechanisms, and a fourth operation mode in which the drive motor is connected only to the second transmission mechanism.

8. The paper transfer assembly according to claim 7, wherein the changeover mechanism comprises a planetary gear mechanism and a control mechanism;

the planetary gear mechanism including a sun gear operatively connected to the drive motor, a first planetary gear held in mesh with the sun gear for revolution therearound while making self-rotation, and a second planetary gear held in mesh with the sun gear for revolution therearound while making self-rotation;

the control mechanism bringing the first planetary gear into connection with the third transmission mechanism in the first operation mode while holding the second planetary gear in a neutral position;

the control mechanism bringing the first planetary gear into connection with the first transmission mechanism in the second operation mode while holding the second planetary gear in the neutral position;

the control mechanism bringing the first and second planetary gears into connection with the first and third transmission mechanisms, respectively, in the third operation mode;

the control mechanism bringing the second planetary gear into connection with the second transmission mechanism in the fourth operation mode while holding the first planetary gear in a neutral position.

9. The paper transfer assembly according to claim 8, wherein the control mechanism comprises a first lever arm for holding the first planetary gear in its neutral position, a second lever arm for holding the second planetary gear in its neutral position, and an actuation device for moving the first and second lever arms.

10. The paper transfer assembly according to claim 9, wherein the actuation device of the control mechanism is a solenoid.

11. The paper transfer assembly according to claim 7, further comprising a cutter device operatively connected to the second transmission mechanism for cutting the first paper in the fourth operation mode.

12. The paper transfer assembly according to claim 7, further comprising a reversal mechanism connecting the first transmission mechanism and the second transmission mechanism for reversely moving the first paper in the fourth operation mode.

13. A paper transfer assembly, comprising:

a drive motor which is reversibly rotatable;

a paper transfer roller for transferring a paper;

a cutter device for cutting the paper;

a first transmission mechanism connected to the paper transfer roller;

a second transmission mechanism separate from the first transmission mechanism for driving at least the cutter device; and a changeover mechanism for releasably connecting the drive motor to the first transmission mechanism to rotate the paper transfer roller in a forward direction when the motor is rotated in a first direction, and for releasably connecting the drive motor to the second transmission mechanism to drive the cutting device when the motor is rotated in a second direction opposite to said first direction.

14. The paper transfer assembly according to claim 13, further comprising a reversal mechanism for connecting the first transmission mechanism and the second transmission mechanism so that the second transmission mechanism performs another function, the cutting device being replaced by the reversal mechanism.

15. The paper transfer assembly according to claim 14, wherein said another function is rotating the paper transfer roller in a reverse direction via the reversal mechanism and the first transmission mechanism when the motor is rotated in a second direction opposite to said first direction.

* * * * *